United States Patent [19]

Gerek et al.

[11] 4,150,164

[45] Apr. 17, 1979

[54] PROCESS FOR HEATING CYLINDRICAL CONTAINERS WITH A PLASMA ARC GENERATED FLAME

[75] Inventors: Gene Gerek; Robert G. Coucher, both of Salt Lake City, Utah

[73] Assignee: W. R. Grace & Co., Cambridge, Mass.

[21] Appl. No.: 814,455

[22] Filed: Jul. 11, 1977

Related U.S. Application Data

[63] Continuation-in-part of Ser. No. 430,094, Jan. 2, 1974, Pat. No. 3,962,486, Ser. No. 486,464, Jul. 8, 1974, Pat. No. 3,947,617, Ser. No. 526,735, Nov. 25, 1974, Pat. No. 4,025,664, and Ser. No. 588,787, Jun. 20, 1975, abandoned.

[51] Int. Cl.[2] ..... B05D 1/00; B05D 1/08; B05D 3/02; B05D 3/08

[52] U.S. Cl. ..... 427/34; 113/120 A; 427/181; 427/183; 427/195; 427/231; 427/233; 427/234; 427/236; 427/239; 427/318; 427/425

[58] Field of Search ..... 427/28, 29, 34, 181, 427/182, 183, 195, 231, 233, 234, 236, 239, 318, 425; 53/36, 43; 29/458; 113/120 A

[56] References Cited

U.S. PATENT DOCUMENTS

| | | | |
|---|---|---|---|
| 2,189,783 | 2/1940 | Eberhart | 427/233 |
| 2,676,895 | 4/1954 | Russell | 427/233 |
| 2,927,044 | 3/1960 | Gough | 427/233 |
| 3,247,004 | 4/1966 | Dosser | 427/233 X |
| 3,355,309 | 11/1967 | Bender et al. | 427/233 X |
| 3,493,415 | 2/1970 | Grisaffe et al. | 427/318 X |
| 3,669,738 | 6/1972 | Cottis et al. | 427/233 X |
| 3,697,313 | 10/1972 | Stumphauser et al. | 427/233 |
| 3,726,711 | 4/1973 | Hagstrom | 427/233 |
| 3,745,035 | 7/1973 | Troughton et al. | 427/181 |
| 3,778,292 | 12/1973 | Rood et al. | 427/236 |
| 3,797,456 | 3/1974 | Hogstrom | 427/233 X |
| 3,816,165 | 6/1974 | Horvath et al. | 427/236 |
| 3,896,602 | 7/1975 | Petterson | 53/43 X |
| 4,025,664 | 5/1977 | Gerek et al. | 427/183 |

*Primary Examiner*—Shrive P. Beck
*Attorney, Agent, or Firm*—Trask & Britt

[57] ABSTRACT

The interior of cylindrical metal containers are coated with a thin, substantially uniform comestible coating by spraying finely divided resinous particles into the container after it has been preheated by a plasma arc-generated flame to a temperature above the softening point of the resin. The process is capable of coating containers at rates up to about 600 containers per minute with a substantially pore-free film having a thickness less than about one mil to as low as 0.1 mil and lower. Typical of containers coated by the process are conventional two-piece aluminum containers. Typical preheat temperatures are from about 150° F. to about 525° F. for aluminum containers and from about 150° F. to about 1000° F. for steel containers. A typical preheat time is from about 30 to about 300 milliseconds. Typical resins are finely divided thermosetting epoxy powders. The plasma arc device may also be used to post-heat coated containers to mature the coating.

22 Claims, 6 Drawing Figures

PROCESS FOR HEATING CYLINDRICAL CONTAINERS WITH A PLASMA ARC GENERATED FLAME

RELATED DISCLOSURES

This application is a continuation-in-part of copending applications Ser. No. 430,094, filed Jan. 2, 1974, now U.S. Pat. Nos. 3,962,486; 486,464, filed July 8, 1974, now U.S. Pat. Nos. 3,947,617; 526,735, filed Nov. 25, 1974, now U.S. Pat. Nos. 4,025,664; and 588,787, filed June 20, 1975, now abandoned.

BACKGROUND OF THE INVENTION

Small-mouthed containers, primarily of metal but including other types, e.g., heavy duty paper containers, are utilized for many purposes. The predominant use is for the commercial distribution of food and beverages—the ubiquitous "tin can". Although it is not a widely known fact, almost all "tin cans" used for food and beverage purposes are coated on the interior with a thin, e.g., a thickness less than about one mil, comestible (food grade) resinous coating. About 60 million pounds of resin are utilized each year in coatings for food and beverage containers. These organic resinous coatings, which may vary in composition dependent upon the ingredient which they will contact, are necessary to prevent contamination of the food or beverage by the metal container, whether said container is tin plated steel or aluminum. Contamination of food and beverage by the metal container generally affect flavor, occasionally makes the food or beverage unwholesome, and frequently affects appearance. Also, the coating promotes the shelf life of the "canned" ingredients.

A number of different resinous compositions have been utilized with success as coatings for metallic containers, particularly food and beverage containers. Although water-based coatings have been available for a number of years, the films or coating resulting therefrom have not been satisfactory for food and beverage containers; for example, beer becomes turbid when stored for even short durations in metal containers coated with a water-based resinous coating.

The mainstay of the can coating industry has been organic, solvent-based coatings—in spite of the fact that the solvent, which evaporates upon application of the coating, constitutes 80% of the weight of the material and often has a greater cost than the resin which remains on the container. Organic, solvent-based coatings have been successful, however, because thin coatings can be applied to metal containers which do not affect substantially the taste of the food or beverage. Solvent-based coatings, however, have a very distinct disadvantage—a very large quantity of solvent evaporates into the atmosphere adjacent container coating facilities. These organic solvents are generally noxious and frequently toxic.

One approach towards eliminating solvents from container coatings is to use 100% solids coating systems; e.g., the liquid styrene-polyester systems, epoxy resins and the like. Liquid systems containing 100% coatings solids; i.e., everything in the liquid system reacts or interacts to become an integral part of the resinous (polymeric) coating formed upon a substrate, have severe limitations in that few polymeric systems lend themselves to a liquid system wherein one of the reactants is dissolved in another reactant. Also, those 100% solids liquid systems available have such high viscosities that application by spray techniques is impracticable, if not impossible, especially when thin films are desired. A further limitation of 100% solids coatings for containers is the inclusion in the coating of a certain quantity of monomer or low molecular weight polymer which, even present as parts per million, produces odor and usually contributes taste to the coating.

Another type of 100% solids coating material is a powdered, resinous material. Powder coatings, as the term is commonly used, have been applied to objects primarily by fluid bed and electrostatic spray techniques. Fluid bed techniques are unsatisfactory to coat food and beverage containers since such technique coats both the interior and exterior, thereby consuming an uneconomical amount of resin. Also, coatings formed in a fluid bed tend to be relatively thick; e.g., five mils and greater. Electrostatic spray techniques work very well for most objects, although coatings less than one mil thick are difficult to obtain.

However, electrostatic spray principles (a charge on the powder and an opposite charge on the object to be coated) do not work when the interior of a small cylindrical metal container is to be coated. An effect known to the Faraday Cage Effect occurs when powder containing an electrostatic charge is propelled towards the interior of an oppositely charged metal cylindrical container having one closed end, resulting in formation of a partial coating.

A further impediment to replacement of solvent-based coatings for containers, aside from the difficulties encountered in making very thin, pore-free films, has been the coating speed. Commercial container lines, particularly beverage container lines, move at a speed of 250 to 300 containers per minute.

DESCRIPTION OF THE DRAWINGS

The invention is illustrated by the attached figures wherein.

DESCRIPTION OF INVENTION

Figure 1:
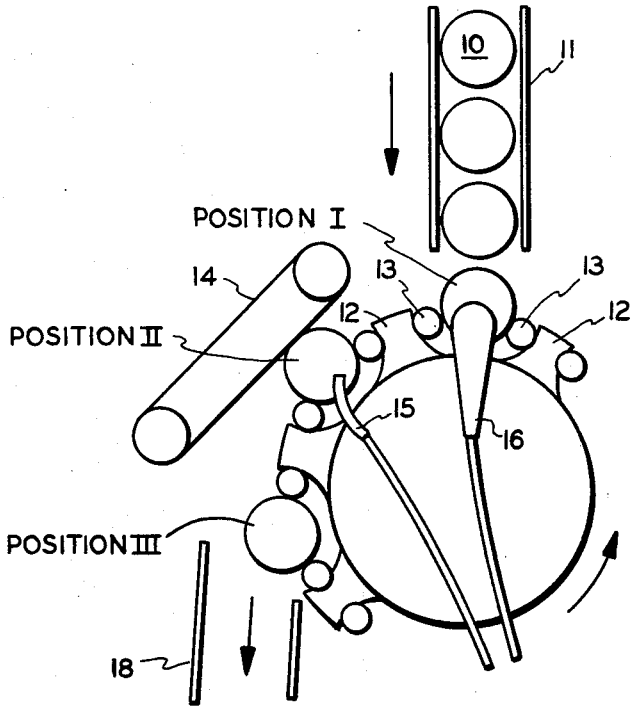
FIG. 1 is an elevational view of a container coating apparatus for a production coating line in which the container is preheated in one position and advanced to a second position for spraying with fine resinous particles.
Figure 2:
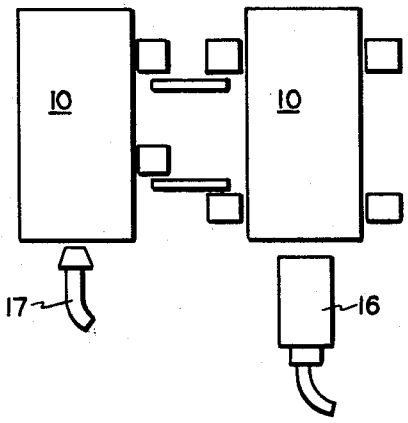
FIG. 2 is a plan view of the coating apparatus of FIG. 1 illustrating the juxtaposition of containers in the preheating and spraying positions.

Slender cylindrical containers having one closed end are heated efficiently and uniformly with a plasma arc generated flame. Because of the configuration of slender, cylindrical containers, it is difficult to heat them uniformly. A plasma arc generated flame, however, provides a compact source of enormous thermal energy which can be directed into the interior of a slender cylinder to heat the container efficiently and uniformly to a desired elevated temperature in a very short duration.

The plasma arc heating of containers is a very effective manner of heating containers to be coated by powder resins techniques, hot melt techniques, or even solvent techniques. It is also an effective manner of post-heating coated containers to cause the film to flow, to drive off solvent or to cause the film to mature.

A process for coating containers, especially slender, cylindrical, metal containers with a thin comestible coating by preheating with a plasma arc device has now been invented. The process applies a coating very rapidly and is readily adaptable to coating containers with a thin, pore-free film at high rates, e.g., up to 600 or more containers per minute.

The process comprises directing a plasma arc generated flame into a container interior for a period sufficient to heat the container to a temperature in excess of the softening temperature of the resin to be applied, which may be as low as about 120° F., but is usually above about 150° F., typically in excess of 200° F., and preferably above 300° F., with best results achieved at container temperatures of about 400° F. to 525° F. for aluminum containers and about 400° F. to about 1000° F. for steel containers.

Immediately after the container is preheated, it is coated with finely divided resin particles, particularly solid particles, before the container has cooled below the softening point of the resin. Finely divided resin powders such as thermoplastic or thermosetting resin powders having a particle size of from about 1 micron or less to about 100 microns, and preferably an average particle size less than about 20 microns, with best results being achieved with an average particle size of less than 5 microns, are sprayed from nozzle, preferably located external the container, into the rapidly rotating container to deposit a substantially uniformly distributed resin coating. Alternatively, the finely divided resin particles may be applied to the container by a reciprocating probe which plunges into the container and radially ejects resin particles on either the inward or outward stroke or on both strokes. In order to maintain a rapid coating speed, it is generally desired that the coating step consume no more than about ½ second and preferably no more than about 300 milliseconds. At present, such high rates are difficult to achieve with an interior probe device.

The powder spray process described in the aforementioned copending application Ser. No. 486,464 by the applicants herein is especially suited for applying resinous coatings at a rapid rate, and the apparatus described in copending applications Ser. Nos. 492,498, filed July 29, 1974 by one of the applicants herein as a joint inventor and 430,721, filed Jan. 4, 1974 by one of the applicants herein are especially suited for handling and ejecting predetermined quantities of resin in a very fast manner. The disclosures of these applications are incorporated herein to the extent that they are applicable hereto.

Preheating with a plasma are generated flame is particularly advantageous for a container coating process wherein the preheating must be done very rapidly. By way of example only, a plasma arc device having a power capacity of about 2,000 watts to about 12,000 watts effectively heats cylindrical metal containers having a diameter less than about three inches and a length to diameter ratio of about 2 to 1 or greater to desired temperature levels at rates of from about 60 containers per minute to about 600 containers per minute. At power levels above about 12,000 watts, the container temperature is often difficult to control because of the very short exposure which can be tolerated; i.e., the high energy output of the plasma arc device tends to produce excessive container temperatures. At container rates of about 200 to about 300 containers per minute, it is presently preferred to utilize a plasma arc device having a power capacity of about 7,000 to about 12,000 watts. A plasma arc device of this capacity is capable of heating a slender, cylindrical beverage container to a desired temperature in about 100 to about 300 milliseconds.

The plasma arc device is particularly advantageous for preheating containers inasmuch as the plasma flame is substantially inert. Preferred ionizable gases for introduction to the plasma arc device include argon, nitrogen, helium and other ionizable gases. Nitrogen is particularly preferred because it is readily available, produces a very hot flame, and produces a preferred radiation spectrum of infrared and ultraviolet radiation. At ionization temperatures of 10,000° C. only a small percent of the nitrogen passed into the ionization chamber, for example, from about 0.2 to about 1.0 percent is ionized. Thus, at the temperatures resulting in the container as a result of preheating with a nitrogen plasma flame, the nitrogen injected into the container is no longer ionized, and the container is consequently swept with an inert gas. Because the nitrogen sweep gas is neither oxidizing nor reducing, its use introduces no corrosion factors to the container. Also, the quantity of ultraviolet radiation present tends to sterilize the container while the elevated temperatures experienced within the container tends to boil off any residual oils, hydrocarbons or the like which typically are present from the forming operations employed to manufacture the container.

A further advantage of the plasma arc device as a preheating means is that it may be made relatively small. Such equipment may be made only a few inches in diameter and in length so that it may be located closely adjacent the spray station. Thus, a container may be readily transported from the preheating station to the spray station without any substantial loss of container temperature.

A preferred embodiment for practicing the instant invention is illustrated in FIG. 1. As heretofore mentioned, present commercial can coating operation operates at an optimum rate of 250 to 300 cans per minute, although a can line may be operated at lower rates, e.g., as slow as 180 cans per minute. The significance of these rates becomes apparent upon examination of the preferred embodiment.

In FIG. 1, cylindrical containers (cans), which in the preferred instance are two-piece containers, i.e., have one closed end, are dropped through an elevator 11 into a cradle formed by a pair of lugs 12 having rollers 13 thereon. The lugs 12 are attached to or are part of a star wheel which rotates about a central axis to transport the containers from the feed elevator 11 to the discharge elevator 18. The containers proceed clockwise in the apparatus illustrated in FIG. 1 from a preheating station (Position I) to a spray station (Position II) to a discharge station (Position III).

As is apparent from the structure of the starwheel, a container resides in Position I and II for exactly the same length of time. Thus, the number of containers which can be coated per minute is limited by the time required at any single position. Because of this inherent time limitation, several characteristics of the instant process become important. One advantage is the short period of time required for either preheating or spraying. A second advantage is the ability of the preheating step and the spraying step to be substantially synchronized; i.e., no single step of the process imposes a substantially different time requirement than any other step.

In Position II the container is rotated at a speed of at least about 500 rpm by means of belt 14 and wheel 15. The container begins to rotate in Position I, although it may not reach maximum rotational velocity until it reaches Position II. Preferably, the container is rotated at the same rotational velocity during preheating as during spraying inasmuch as the turbulence created by rotation facilitates heat transfer. A slender, cylindrical container 10 drops from feed elevator 11 to a preheating station (Position I) where the container is heated by a plasma arc device 16 for a short period, e.g., from about 200 to 300 milliseconds, to a temperature in excess of 225° F., and preferably in excess of 300° F.

The container is then quickly advanced from Position I to Position II by counterclockwise rotation of the starwheel. Finely divided resin particles are uniformly sprayed into the container from a spray nozzle 17 by a carrier gas. At a rotational speed of 500 rpm the container rotates about three rpm during a period of 300 milliseconds. The rotational velocity of the container can be regulated between about 500 and 1800 rpm on commercially available starwheels. A minimum of two revolutions of the container is preferred during the period resin is being sprayed into the container. The resin particles, preferably of a size less than 100 microns, and ideally much smaller, adhere to the container interior in a uniformly distributed manner. The container remains in Position II for the same length of time as in Position I.

From Position II the container advances to Position III, where the container discharges into discharge elevator 18. At position III the coating on the container interior is not fully matured if the preheat temperature has been in the lower range, i.e., about 225° F. to about 300° F., which means that it is not:

(1) a fully cured film, if a thermosetting resin was used, or (2) a fully developed coating, if a thermoplastic resin was used.

For either thermoset or thermoplastic resins, the film produced should ultimately be fully continuous, impermeable, and preferably of a substantially uniform thickness not exceeding about 0.5 mil. Upon initial contact of the resin particles, the temperature of the container is above the softening point of the resin particles but not above the melting point. (The term "melting point" is more applicable to the low molecular weight thermosettable resins than to the high molecular weight thermoplastic resins for which a comparable temperature is the "flow point".) The resin particles at the lower preheat temperatures are sufficiently softened that a substantially continuous film (although the film tends to be round) is formed. The coating formed at the lower temperatures, e.g., 225° F. to 250° F., will generally pass the copper sulfate test conventional in the can coating industry but will often not pass the conventional boiling water or Enamel Rater tests without further processing. By way of example only, a coating formed at low temperatures can be rendered fully matured by postheating at elevated temperatures for a brief period, e.g., 300 milliseconds, before a plasma arc device to elevate the temperature to 425° F. to 500° F., or by immediately transferring to an oven to be heated at 450° F. for a few minutes.

Preheating the container to temperatures of above about 250° F. enables the formation of a continuous film which is substantially uniform in thickness, provided the spray technique is capable of applying such film. Thus, such a film, if the resin is a thermosettable one, requires only a very brief postheating at elevated temperatures to effect curing of the film.

Preheating the container to temperatures in excess of about 350° F. and preferably above about 425° F. permits application of films which are continuous and will fully mature without addition of energy if the thermal energy of the container is conserved. The storage of enough thermal energy in the container to mature fully the coating applied thereto is a unique feature of the instant invention. In the instant process that is achievable even though the preheating and spraying operations are conducted in an environment at ambient temperatures because of the rapid heating to the desired temperature, the rapid transfer of the container from the preheat station to the spray station, the rapid spraying of the container while avoiding conditions, e.g., excess carrier gas, which tend to cool the container, and rapid transfer of the container to a heat conservation zone.

Figure 3:
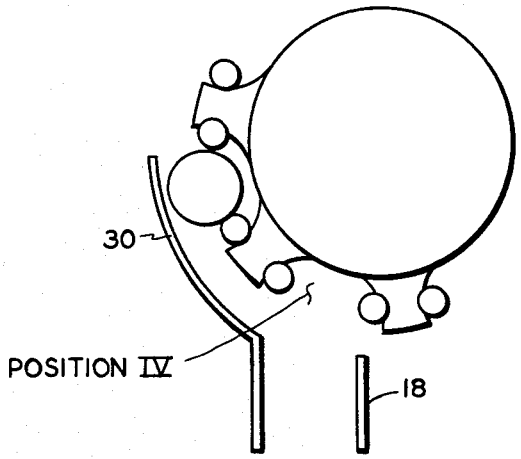
FIG. 3 is a partial elevational view of a modified coating apparatus to add a postheating position to the apparatus of FIG. 1.

As illustrated in FIG. 3, a curved retainer band 30 may be positioned alongside the starwheel adjacent Position III to retain the container at Position III for the same period it experienced in Positions I and II. The container is then discharged at Position IV into discharge elevator 18 which has been displaced to a position underneath Position IV. This modification of the starwheel assembly permits postheating of the container in Position III for a period sufficient at a predetermined temperature to cause the coating to mature. A plasma arc device of the type used to preheat is preferred to accomplish the postheating. The degree of postheating required depends upon preheat temperature and resin characteristics.

When preheating is below 300° F., or even below about 350° F., postheating may be delayed for prolonged periods without adversely affecting the coatings upon eventual cure. When preheating temperatures of 300° F. or above are used in conjunction with typical thermosetting resins, it becomes important to raise the temperature of the resin to its curing point, usually 400° F. or more, substantially immediately, ideally within about 3 seconds, following the spray interval. This procedure is especially important when the metal surface temperature of the container at the commencement of the spray interval is about 350° F. or higher.

A typical thermoset resin, for example, one having a softening point of about 120° F. to about 150° F., a "melting point" of about 300° F. to about 350° F. and a curing temperature of about 350° F. to about 500° F., requires postheating when the container is preheated to a temperature if only 150° F. to about 250° F., and even as high as 300° F. because some cooling occurs between Positions I and III so that the temperature of the resin never reaches its curing point (or flow point for a thermoplastic resin). However, with such resins it has been determined that preheating the container to temperatures greater than 425° F., and preferably about 450° F., (but not in excess of 525° F. for aluminum containers) is sufficient input of thermal energy to cause the resin particles to adhere, to flow immediately into a continuous, pore-free film of substantially uniform thickness and to cure, if thermal energy losses, (e.g., convection and radiation losses) are substantially minimized. Thermal energy loss can be prevented by supplying thermal energy as fast as it is lost, e.g., a mild postheat, or by conveying the container immediately after spraying to an insulated conveyor whereby heat losses are minimized.

In FIG. 1, a container preheated to a temperature of 425° F. or greater in Position I is conveyed to Position II for spraying and is then discharged at Position III into the discharge elevator. Insulating elevator 18 and a portion of the conveyor system following thereafter for a distance sufficient to maintain the container temperature above 350° for a period of about one to two minutes. At a container rate of 250 containers per minute and a container diameter of two inches, a single line conveyor insulated for a distance of about 40 feet enables the containers to be conveyed in a insulated environment for about one minute.

A significant energy savings is realized through conservation of the preheat energy to mature fully the resin film. Although the mass of metal containers, particularly aluminum containers, is small in relation to area, the preheating step with a plasma arc generated flame has been found effective to produce a container with a fully matured film on the container interior without requiring additional heat. A further significant advantage of the instant invention is that the preheating step, spraying step and postheating step, if desired or required, can be accomplished in such a very confined space and in such a short time that substantially no thermal energy imparted to the container is lost to the environment.

Figure 4:
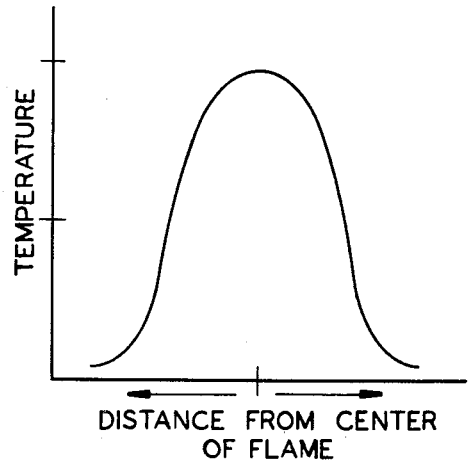
FIG. 4 illustrates the temperature distribution within a nitrogen plasma arc flame.
Figure 5:
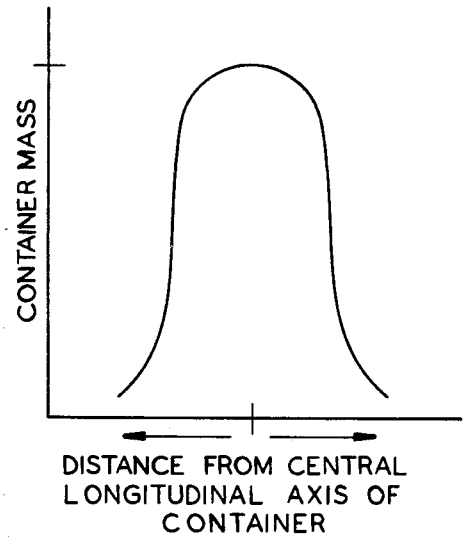
FIG. 5 illustrates the metal distribution within a thin-walled two-piece aluminum beverage container.

A particular advantage of heating a two-piece container with a plasma arc generated flame, particularly a nitrogen generated flame, is illustrated in FIGS. 4 and 5. FIG. 4 illustrates the temperature distribution of a plasma arc flame. The temperature of the flame is very high at the central core of the flame. Thus, for the distance of the flame length, a central core with a very high temperature, e.g., 10,000° F. or more depending upon the type of ionizing gas used, exists while radially from the central core the temperature decreases rapidly until the temperature at a distance of two inches laterally from the central core is perhaps 150° F.

The metal distribution in a container is somewhat similar inasmuch as the closed end of the container (base) contains a much thicker metal than the side walls while the lip of the mouth (open end) of the container is slightly heavier. Thus, in the container the greatest mass/unit area is in the base while the lowest mass/unit area is in the side walls.

The plasma arc generated flame, especially a flame generated by ionized nitrogen, provides an energy profile uniquely adapted to heat a slender cylindrical container having one end thereon, especially an aluminum container which has been drawn and ironed from a single piece of aluminum. The higher temperatures are in the neightborhood of the thick metal areas so that the increase in metal temperature is more uniform than can be accomplished by other techniques. In practice, the actual heat distribution obtained with plasma heating is uneven. The process is tolerant of the degree of uneven heat distribution obtained by plasma heating, however, because of the wide range of permissible preheat temperatures.

The plasma arc device may be readily utilized in postheating slender, cylindrical containers which have been coated with a variety of coating materials, e.g., resinous powders, solvent-based resins and the like. Postheating of coated containers is frequently practiced to mature the coating or to drive off solvent.

EXAMPLE I

A slender, cylindrical beer container having one end thereon was coated with a thin, resinous coating. The container, approximately 5¼ inches in length by about 2½ inches in diameter, had an interior area of about 43 square inches.

Figure 6:
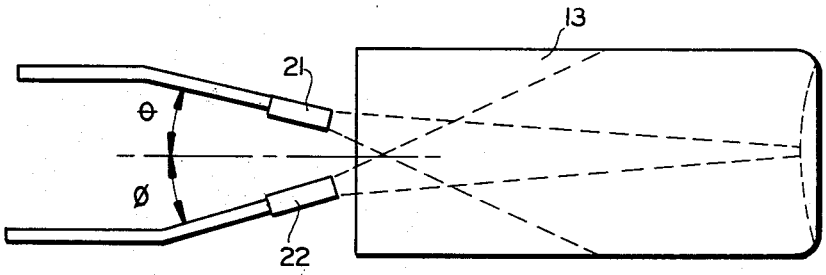
FIG. 6 illustrates a typical spray pattern for a dual nozzle container coating system.

The container was placed in an apparatus similar to FIG. 1 wherein a pair of nozzles as illustrated in FIG. 6 were utilized. Nozzle No. 1 was located about 1 inch from the mouth of the container and at an angle of about 10° from the longitudinal axis of the container. The spray from Nozzle No. 1 was directed at a portion of the container side wall. Nozzle No. 2 was located about ½ inch from the mouth of the container and at an angle 3° from the longitudinal axis of the container. The spray from Nozzle No. 2 was directed to contact the moat and about one-half the domed area of the bottom of the container opposite the spray nozzle.

Each nozzle was connected to a resin pulsing device of the type described in copending application Ser. No. 492,498 wherein a resin/gas mixture could be provided from the pulsator to each nozzle for a predetermined duration of about 50 milliseconds to about 300 milliseconds. A constant amount of resin may be provided regardless of the duration of the spray period. A chamber of different volume can be placed in the pulsator to change the quantity of resin provided during a spray period. The volume and velocity of gas carrying the resin may be increased or decreased by increasing or decreasing the pressure of the gas provided to the pulsator.

Powdered resin was placed in each hopper of a pulsator. The powder was a thermosettable epoxy resin, Epon 1004 with 6% by weight dicyandiamide catalyst, having a particle size range from about 10 microns to about 100 microns with an average particle size of about 30 microns.

A two-piece aluminum beer container (Container No. 1), having an interior area of about 43 square inches, was heated to about 150° F. by a plasma arc flame. The container was placed in front of spray nozzles Nos. 1 and 2 as illustrated in FIG. 6. The container was not rotated in that position. The carrier gas pressure was set at 90 psi gauge. Two 80 millisecond bursts of gas and resin were directed into the container. The resin was sprayed first from Nozzle No. 1 and about 30 milliseconds later resin was sprayed from Nozzle No. 2. A total of about 700 milligrams of resin was sprayed, of which only about 350 milligrams adhered to the container interior. Large areas of the container were bare even after heating the container at 425° F. for a period sufficient to cause film continuity on certain parts of the container. The coating was unacceptable for any purpose.

A two-piece aluminum beer container (Container No. 2) having an interior area of about 43 square inches was heated to about 150° F. by a plasma arc flame while being rotated. The container was sprayed in the same manner as Container No. 1 just described except that the container was rotated at a speed of about 500 rpm. A continuous coating was formed which cured upon postheating at 425° F. for about three minutes. A total film weight of about 400 milligrams was present. The coating exhibited an acceptable film conductivity, less than 75 milliamps, when tested in an Enamel-Rater.

A third container (Container No. 3) was sprayed in the same manner as Container No. 2 except that the container was rotated at about 1800 rpm after having been preheated to 425° F. while being rotated. A continuous film having a total weight of about 400 milligrams of very uniform distribution was immediately formed upon contact of the resin particles with the container. The coating was at least partially cured and upon postheating at 425° F. for sixty seconds, the coating was fully cured and exhibited a film conductivity of only three milliamps when tested in an Enamel-rater.

A fourth container (Container No. 4) was sprayed in the same manner as Container No. 3 except that the container was preheated to about 500° F. while being rotated. A continuous film having a total weight of about 400 milligrams of very uniform distribution was immediately formed upon contact of the resin particles with the container. The container was at least partially cured and upon being insulated in an insulated box having a temperature of about 400° F., the coating was fully cured and exhibited a film conductivity of only three milliamps when tested in an Enamel-Rater.

In the description of the instant invention, both film weights per unit area and film thicknesses have been referred to. The following table provides an equivalency guide between these means of identifying film thickness and provides an equivalent weight for a 12 ounce beer container having an internal surface area of 43 square inches.

| Film Weight in Milligrams | | Film Thickness |
|---|---|---|
| 12 Ounce Container | Per Square Inch | in Mils |
| 860 | 20 | 1 |
| 430 | 10 | 0.5 |
| 215 | 5 | 0.25 |
| 107 | 2.5 | 0.125 |
| 86 | 2.0 | 0.10 |

A particularly preferred technique for coating containers according to the instant invention comprises use of a pair of nozzles, as in FIG. 6, wherein the nozzles are angled away from the longitudinal axis of the container and each located at an angle of about three degrees to about seven degrees from the central longitudinal axis of the container so that the spray pattern from each diverge (rather than converge, as illustrated in FIG. 6), and wherein the nozzles are located at about one to about two inches appart and preferably from about 1.5 to about 1.7 inches. Preferred distance of the nozzles from container mouth is from about 0.03 to about 0.5 inches. The spray pattern emanating from each nozzle is preferably a fan or cone shape having an included angle at the nozzle of about 40 to 45 degrees. Ideally, the nozzles are discharged simultaneously.

CONDUCTIVITY DETERMINATION

The film conductivity (Enamel-Rater) test employed in evaluating container coating integrity involves impressing a twelve volt constant voltage upon an electroyltic cell having as one electrode the container body with a stainless steel electrode immersed in an aqueous electrolyte, preferably a 10% sodium chloride solution. Although other salts such as potassium chloride, sodium carbonate and the like at concentrations of about five to thirty-five percent may be employed. The electrolyte occupies most of the container volume.

The purpose of the film conductivity test is to predict migration of iron or aluminum ions from the container into the contents of the container. It is estimated that a twelve ounce aluminum beer container having a film conductivity of 75 milliamps would experience a migration of about 150 to 200 parts per million of aluminum ions through the coating and into the beer during a storage period of about three months.

A higher film conductivity (less film integrity) can be tolerated for beer containers than for soft drink containers because of the greater acidity of soft drinks. For example, a film conductivity of 75 milliamps is generally regarded as acceptable for beer containers while a 10 milliamp conductivity is considered an upper limit for soft drink containers. The tolerable film conductivity or film integrity may vary if the storage time of the container with contents is known to be short; for example, a container whose contents are used within one month after filling may be acceptable even though it has a film conductivity three times as great as a filled container which has a storage life of three months.

The invention as presently envisioned contemplates coating either a two-piece container (one with an integral closed end) or a three-piece container (one with both ends open). In the second instance, a closure for one end, e.g., a spray plate, is provided to seal one end of the container during the spray interval. The interior surface of the container is then heated (preheat) to a temperature above the softening point of the resin to be used. Useful preheat temperature may be as low as 150° F., but normally exceed 225° F., and preheat temperatures in excess of 300° F. are generally preferred. The container is rotated during the spray interval, preferably at least two revolutions. A predetermined quantity of resin is pheumatically conveyed into the interior of the container during the spray interval through the open end of the container, preferably through one or more nozzles located outside the container under conditions wherein:

(a) The resin is in powder form and has a maximum particle diameter of less than about 20 microns. Preferably the resin particles are approximately round (or at least rounded) and the average diameter of the particles is about 8 microns.

(b) The particle velocity of the resin is sufficient to penetrate through the static air barrier adjacent the interior surface of the container.

(c) The resin is ideally conveyed at an approximately uniform rate throughout the spray interval.

Following the spray interval, the thus-applied resin is heated (postheating) to cure it into a substantially uniform, solvent-free, ultra-thin coating. Ideally, the spray interval is less than about 150 milliseconds. Moreover, it is highly preferred to correlate the resin composition with the preheat temperature so that the individual particles adhere to the surface, melt, flow, gel and partially cure, all within a period of less than about 150 milliseconds. Typical useful thermoset epoxy resins have softening points of between about 120° F. and about 150° F., and useful postheat temperatures for such resins usually exceed 350° F., e.g., 400° F. or more. Of course, other parameters may be preferred when thermoplastic resins are used. The resin is often introduced through a plurality of nozzles and/or in a plurality of pulsed quanta.

The procedures described herein are intended for adaptation to a commercial can line which includes a mechanism for rotating the cans around their longitudinal axes. Each can of a series is mounted in the mechanism in turn and the spray intervals are synchronized to begin when each thus-mounted can has rotated a predetermined amount, e.g., about one-half revolution. The spray intervals are spaced to permit the ejection of a coated container from the spinning mechanism and the delivery of the next container of the series to the mechanism.

The methods of this invention are useful for producing a broad class of coated metal containers heretofore unknown within the art. The useful substrate (interior surface) may be either light or heavy guage aluminum, tin plate, convential container quality steel, or tin-free steel, as well as any other metal useful for producing a container of the type commonly referred to as a "tin can". This substrate is coated with a substantially uniform, continuous, solvent-free, thin layer of resinous material. The resulting containers have broad utility, particularly for the storage of food and beverages.

Although the invention has been described by reference to specific embodiments, it is not intended to be limited solely thereto but to include all the modifications and variations falling within the scope of the appended claims.

We claim:

1. A process for applying a film coating less than about 1 mil thick to the interior surface of a metal container of the type commonly called a "tin can" comprising:

(a) directing a plasma arc generated flame into said container interior for a period sufficient to heat the interior surface of said container to a temperature in excess of about 150° F.; and (b) spraying into the interior of said container a predetermined quantity of finely divided resin particles sufficient to coat said interior surface with a continuous film, said resin having a softening point lower than said surface temperature.

2. The process of claim 1 wherein said metal container is a slender, cylindrical, two-piece container.

3. The process of claim 2 wherein the interior surface of said container is preheated to a temperature of at least 225° F.

4. The process of claim 2 wherein said metal container is aluminum.

5. The process of claim 4 wherein the interior surface of said aluminum container is heated to a temperature of about 425° F. to about 525° F.

6. The process of claim 2 wherein said container is of steel.

7. The process of claim 1 wherein said plasma arc generated flame is produced substantially from nitrogen.

8. The process of claim 7 wherein said flame temperature is substantially in excess of 6000° F.

9. The process of claim 6 wherein said container is preheated by said flame for a period of about 0.05 to about 0.3 seconds.

10. The process of claim 1 wherein said resin comprises solid, finely divided resin particles.

11. The process of claim 1 wherein said resin comprises liquid resin particles.

12. The process of claim 1 wherein said sprayed container is postheated at a temperature sufficient to cause said resin to flow.

13. The process of claim 10 wherein said resin is a thermoset resin.

14. The process of claim 13 wherein said resin has a softening point of about 120° F. to about 150° F.

15. The process of claim 12 wherein said postheating is performed by directing a plasma arc generated flame into the interior of said container.

16. The process of claim 13 wherein said thermoset resin has a curing temperature above about 350° F.

17. The process of claim 16 wherein said thermoset resin is an epoxy resin.

18. A continuous process for coating in sequence a plurality of two-piece, cylindrical, metal containers of the type commonly called a "tin can" comprising:

(a) advancing each container in sequence to a preheating station and then, with respect to each container in sequence;

(b) directing a plasma flame into said container for a period sufficient to preheat the container so that its interior surface is raised to a temperature in excess of about 150° F.;

(c) advancing said container from said preheating station to a spray station closely adjacent to said preheating station at a speed sufficiently rapid that said container experiences substantially no cooling;

(d) rotating said container;

(e) spraying into the interior of said rotating container from a position outside of said container a predetermined quantity of finely divided resin particles sufficient to coat the container interior with a continuous film less than about 1 mil thick, said resin particles being carried by a gas stream at a velocity sufficient to penetrate the static air barrier adjacent the interior surface of the containers and said resin having a softening point lower than the temperature of the interior surface of said container;

(f) advancing said container to a coating curing station; and (g) curing said coating into a substantially pore-free, continuous, substantially uniform film less than about 1 mil thick.

19. The continuous process of claim 18 wherein said preheating temperature is at least 225° F.

20. The continuous process of claim 18 wherein said preheating temperature is at least 425° F.

21. The continuous process of claim 18 wherein said coating curing comprises postheating said container to a temperature in excess of about 350° F.

22. The continuous process of claim 20 wherein said coating curing comprises retaining said thermal energy of the container so that temperature decrease is sufficiently gradual to cause said coating to cure.

* * * * *

UNITED STATES PATENT OFFICE

CERTIFICATE OF CORRECTION

Patent No. 4,150,164 Dated April 17, 1979

Inventor(s) Gene Gerek and Robert G. Coucher

It is certified that error appears in the above-identified patent and that said Letters Patent are hereby corrected as shown below:

Col. 3, line 58, change "are" to--arc--;

Col. 10, line 9, change "less" to--lesser--;

Signed and Sealed this

*Eighteenth* Day of *September 1979*

[SEAL]

*Attest:*

*Attesting Officer*

LUTRELLE F. PARKER

*Acting Commissioner of Patents and Trademarks*